US006659716B1

(12) United States Patent
Laurello et al.

(10) Patent No.: US 6,659,716 B1
(45) Date of Patent: Dec. 9, 2003

(54) GAS TURBINE HAVING THERMALLY INSULATING RINGS

(75) Inventors: Vincent Laurello, Miami, FL (US); Masanori Yuri, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/195,103

(22) Filed: Jul. 15, 2002

(51) Int. Cl.[7] ..... F01D 11/24

(52) U.S. Cl. ..... 415/116; 415/173.1; 415/173.2; 415/175; 415/176; 415/178

(58) Field of Search ..... 415/115, 116, 415/175–178, 173.1, 173.2, 138, 139

(56) References Cited

U.S. PATENT DOCUMENTS 3,841,787 A * 10/1974 Scalzo ..... 415/138
5,048,288 A * 9/1991 Bessette et al. ..... 415/116
5,281,085 A * 1/1994 Lenahan et al. ..... 415/116
6,508,623 B1 * 1/2003 Shiozaki et al. ..... 415/173.1
6,533,542 B2 * 3/2003 Sugishita et al. ..... 415/139

FOREIGN PATENT DOCUMENTS

| | | |
|---|---|---|
| JP | 5-86809 | 4/1993 |
| JP | 2568645 | 10/1996 |
| JP | 10-252410 | 9/1998 |
| JP | 2941748 | 6/1999 |

* cited by examiner

*Primary Examiner*—Christopher Verdier
(74) *Attorney, Agent, or Firm*—Oblon, Spivak, McClelland, Maier & Neustadt, P.C.

(57) ABSTRACT

A gas turbine capable of minimizing the clearance between each of the rotor blades and partition ring, uses a structure in which the upstream thermally insulating ring is installed on the downstream blade ring.

9 Claims, 4 Drawing Sheets

GAS TURBINE HAVING THERMALLY INSULATING RINGS

BACKGROUND OF THE INVENTION

1. Field of the Invention

The present invention relates to a gas turbine that can guarantee optimal clearance dimensions between rotor blades and a partition ring during operation.

2. Description of the Related Art

FIG. 2 shows an example of the schematic structure of a gas turbine plant. The gas turbine plant shown in this figure comprises a compressor 10, a combustor 20, and a gas turbine 30. In this gas turbine plant, the compressed air that has been compressed by the compressor 10 is supplied to the combustor 20, mixed with fuel supplied separately, and burned. The combusted gas generated by this combustion is supplied to the gas turbine 30, and a rotational drive force is generated by the gas turbine.

Specifically, as shown in FIG. 3, inside the gas turbine 30, a plurality of rotor blades 32 installed on the rotor 31 side and a plurality of stationary blades 33 installed on the stationary side on the periphery of the rotor 31 (not illustrated) are disposed alternating in the axial direction (the left to right direction in the figure) of the rotor 31, and a combustion gas flow path 34 that passes therethrough is formed. Thereby, when the combustion gas supplied into the gas turbine 30 passes through the combustion gas flow path 34, a rotational force is applied to the rotor 31 due to the rotation of each of the rotor blades 32. This rotational force rotates the generators (not illustrated) connected to the rotor 31 to generate electricity.

However, in this gas turbine 30, in order to introduce combustion gas into the interior, the components which have been heated to a high temperature must be cooled, and as shown in FIG. 2, a structure is generally used in which for example, a portion of the compressed air that has been compressed by the compressor 10 is incorporated into an a bleed and used to cool each of the rotor blades 32 and the stator blades 33.

Among these multistage structures, the details of the bleed intake structure in the first stage will be explained below with reference to FIG. 4. Moreover, this figure is an enlargement corresponding to part A in FIG. 3, where the left side of the page is the upstream flow direction of the combustion gas and the right side of the page is the downstream side.

On the outer periphery of each of the rotor blades 32, a partition ring 35 having a ring shape is formed so as to conform to these rotor blades 32, and the partition ring 35 is supported and anchored via the pair of thermally insulating rings 36*a* and 36*b*. In order to avoid contact between each of the rotor blades 32 and the partition ring 35, a predetermined clearance c is provided between the outer peripheral edge of each of the rotor blades 32 and the inner peripheral surface of the partition rings 35.

The flow path 38*a* that opens towards the partition ring 35 is formed by the first stage rotor blades 32, and the bleed f brought in from outside the gas turbine 30 is introduced.

Each of the thermally insulating rings 36*a* and 36*b* are a pair of ring shaped parts separated from each other, and in the outside peripheral part thereof, they are separately anchored within the first stage blade ring 38.

In addition, a ring shaped impinging plate 39 and a partition ring 35 are installed and anchored is a state in which they are interposed between the thermally insulating rings 36*a* and 36*b*. A plurality of through holes 39*a* are bored at substantially equal intervals with respect to the outer peripheral surface of a partition ring 35 for distributing and supplying the vapor oil f taken in via the flow path 38*a*.

The flanges 35*a* and 35*b* are formed at the upstream side and the downstream side of the outer peripheral surface of the partition rings 35, and these flanges 35*a* and 35*b* are engaged in a recess formed in each of the thermally insulating rings 36*a* and 36*b*. Similarly, both ends of the impinging plate 39 engage in the recesses formed in each of the thermally insulating rings 36*a* and 36*b*.

On the partition rings 35, a plurality of cooling paths 35*c* that pass from the upstream side of the outer peripheral surface thereof through the interior to the downstream side end surface are formed.

The above explains the first stage structure among the plurality of stages, but the second and subsequent stages positioned on the downstream side therefrom also have substantially the same structure.

However, the clearance c changes due to the differences in thermal expansion between each of the structural components. When this becomes excessively large, there is the problem that the capacity of the gas turbine 30 drastically deteriorates. From this point of view, using an optimal clearance that takes into consideration the differences in thermal expansion between each of the structural components is necessary during the design stage.

However, actually the amount of thermal deformation of each component (for example, the blade rings of each stage starting with the first stage blade ring 38) differs at each of the stages, and thus optimal design is difficult. That is, because the flow conditions (temperature and the like) of the bleed f that cools each of the stages differs for each stage, there is the problem that it is difficult to design with a high precision the clearance c for each of the stages that conforms to the actual shape during operation.

Among these stages, the difference in thermal expansion between the first stage and the second stage is severe, and for example, when the temperature of the members of the second stage blade rings 38A, which are the blade rings of the second stage, is approximately 360° C., at the first stage blade ring 38, the temperature of the members is a comparatively high 450° C., and thus the clearance c of the first stage has a tendency to become larger than that of the second stage during operation.

The combustion gas flow path 34 has a shape in which the width dimension of the flow path gradually widens from the upstream side to the downstream side at each stage, and thus for the same clearance c, at the upstream first stage, whose flow path width is comparatively narrow, the amount of fluctuation of the clearance c with respect to the flow path width greatly influences the power of the gas turbine 30. Against this background, a structure in which the clearance c is optimal during operation is desired.

In consideration of the above, it is an object of the present invention to provide a gas turbine that can minimize the clearance between each of the rotor blades and the partition rings during operation.

SUMMARY OF THE INVENTION

Figure 1:
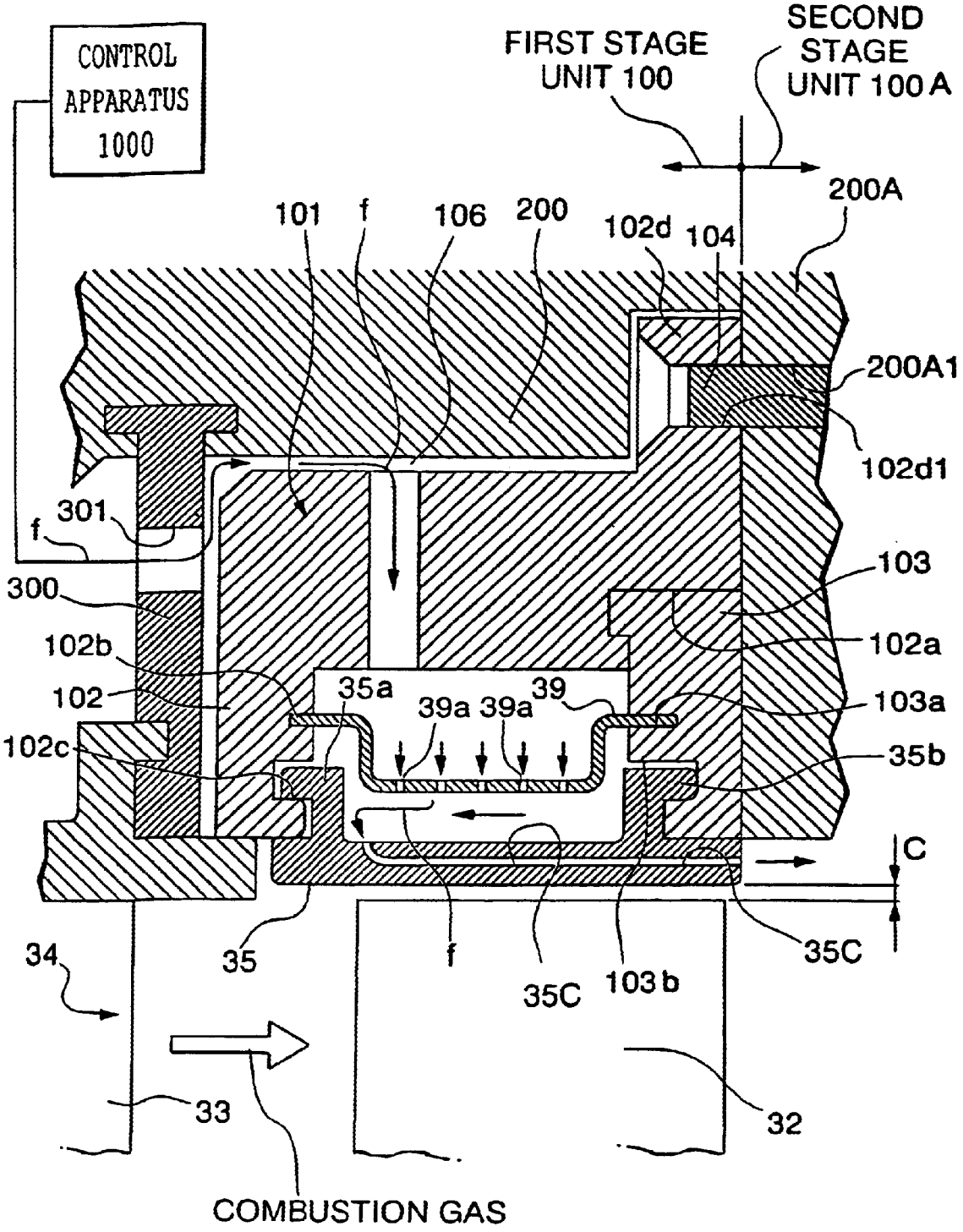
FIG. 1 is a diagram showing one embodiment of the present invention and a enlarged diagram of the A section shown in FIG. 3.

The present invention uses the following device to solve the problems described above.

The first aspect of the present invention provide a gas turbine comprising, a plurality of rotor blades, which are disposed on the periphery of the rotor and rotate with the rotor, a plurality of partition rings which enclose the periphery of these rotor blades and forms a combustion gas flow path therein; and a plurality of blade rings which are disposed around the periphery of said partition rings and support said partition rings through a thermally insulating ring, wherein, when viewing from the axial direction of said rotor, the upstream thermally insulating ring, that supports the partition ring located relatively upstream among said plurality of partition rings, is installed on the downstream blade ring, which is positioned downstream of said blade ring, which corresponds to said upstream thermally insulating ring.

In the gas turbine according to the first aspect of the present invention, since the downstream blade rings that have a temperature lower than that of upstream blade rings positioned relatively on the upstream side has smaller amount of thermal expansion during operation, and thus, in comparison to the conventional installation of upstream thermally insulating rings on the blade rings of the upstream blade rings, the amount of the thermal expansion of the upstream thermally insulating rings can be limited to a small amount.

According to the second aspect of the present invention, the gas turbine according to the first aspect has a cantilever support structure in which an upstream thermally insulating ring is supported by a downstream blade ring when viewed in a cross-section along the axis of the rotor.

In the gas turbine according to the second aspect, the operation of the gas turbine described in the first aspect can be reliably obtained.

According to the third aspect of the present invention, in the gas turbine according to the first and second aspects, the upstream thermally insulating ring has a first member positioned relatively upstream in the direction of the flow of the combustion gas and a second member positioned on the downstream side with respect to the first member, and with respect to the downstream blade ring, the first member is installed in a state wherein the second member is interposed between the first member and the downstream blade ring.

In the gas turbine according to the third aspect, when maintaining the upstream thermally insulating rings in the gas turbine, it is possible to carry out simultaneously the removal of the second member and the separation of the first member from the second member by simply removing the first member from the downstream blade ring.

According to the fourth aspect of the present invention, in the gas turbine according to the third aspect, the other member is interposed between the first member and the second member.

In the gas turbine according to the fourth aspect, when maintaining the upstream thermally insulating rings of the gas turbine, it is possible to carry out simultaneously the removal of the second member and the separation of the first member from the second member by simply removing the first member from the downstream blade ring. Here, an impingement plate, for example, can be used as the aforementioned another member.

According to the fifth aspect of the present invention, in the gas turbine according to the fourth aspect, the other member can be integrally formed with either the first member or the second member.

The gas turbine according to the fifth aspect, the number of parts can be decreased, and thus the manufacturing cost can be reduced. In addition, the number of assembly steps can be reduced.

A sixth aspect of the present invention, in the gas turbine according to the third and fourth aspects, the fist member and the second member are integrally formed.

The gas turbine according to the sixth aspect, the number of parts can be reduced, and thus the manufacturing cost can be reduced.

A seventh aspect of the present invention, in the gas turbine according to any one of the first through sixth aspects, a clearance flow path, for flowing the cooling bleed towards said partition ring supported by said upstream thermally insulating ring, is formed between the upstream blade ring that covers the periphery of said upstream thermally insulating ring and said upstream thermally insulating ring.

The gas turbine according to the seventh aspect, formation of through holes for supplying bleed toward the partition ring supported by said upstream thermally insulating ring becomes unnecessary by forming the clearance flow path.

According to the eighth aspect of the present invention, in the gas turbine according to any one of the first through seventh aspects, the gas turbine further comprises a control unit that controls one or both of the temperature or the flow rate of the cooling bleed for cooling said partition ring, which is supported by said upstream thermally insulating ring.

In the gas turbine according to the eighth aspect, it becomes possible to actively control (active control) the dimension of the clearance formed between each of rotor blade and the partition ring in the unit stage having a partition ring supported by the upstream side thermally insulating ring. That is, by carrying out one of either lowering the bleed temperature or the bleed flow rate, the clearance can be narrowed. Contrariwise, by carrying out one of either raising the bleed temperature or lowering the bleed flow rate, the clearance can be widened.

According to the ninth aspect of the present invention, in the gas turbine according to the first aspect, the partition ring supported by said upstream thermally insulating ring is positioned in the first stage unit that is located furthest upstream in said axial direction of said rotor, and said downstream blade ring is positioned in the second stage unit located adjacent to said first stage unit.

In the gas turbine according to the ninth aspect, since the clearance between each of the rotor blades and the partition ring of the first stage unit located the furthest upstream has the greatest influence among the unit stages on the power loss of the gas turbine, the effect of the present invention can be effectively exhibited by controlling the clearance.

BRIEF DESCRIPTION OF THE DRAWINGS

Figure 3:
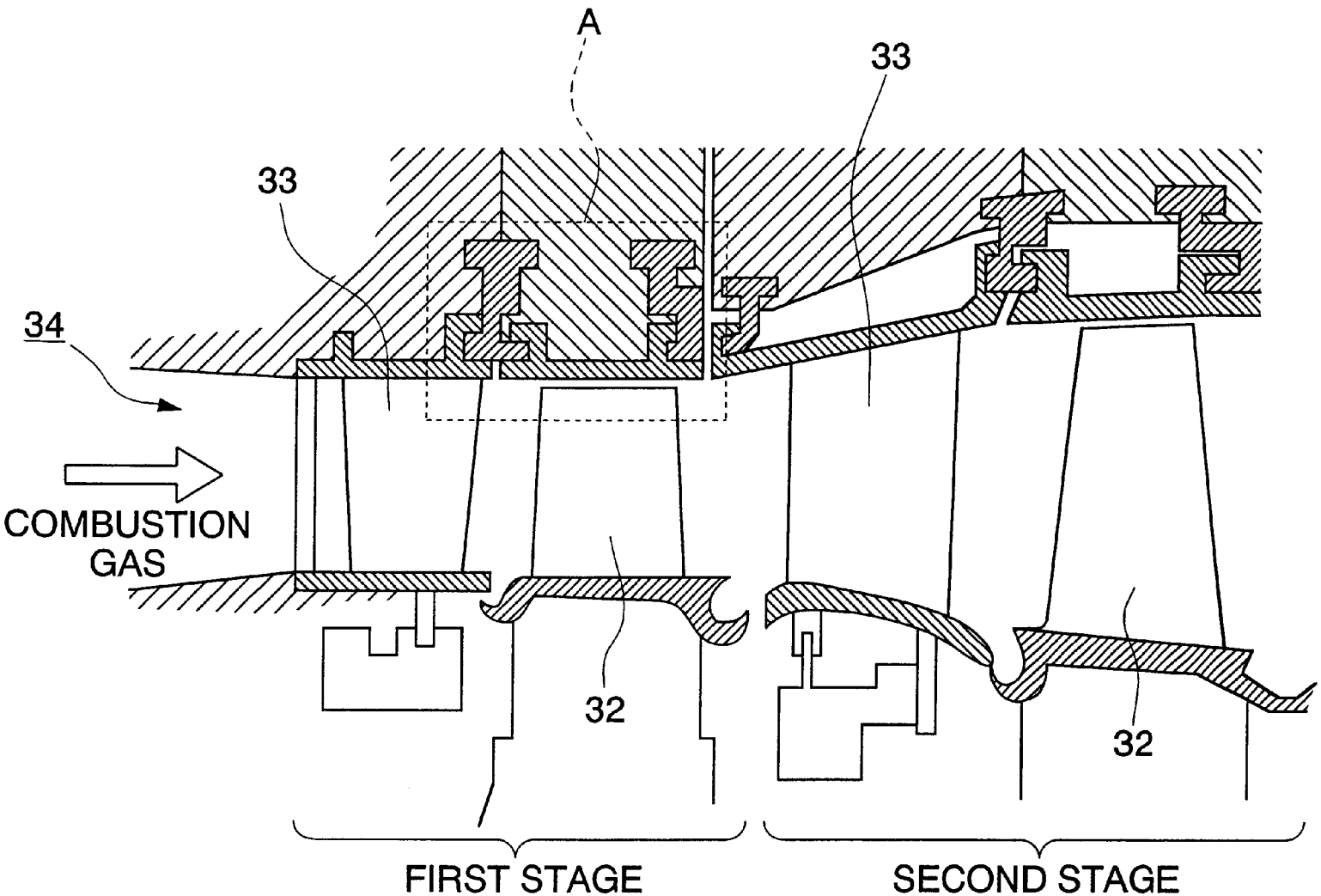
FIG. 3 is a diagram showing the combustion gas path of the gas turbine plant and a partial cross-sectional view of the section including the axial direction of the rotor.

FIG. 1 is a drawing showing an embodiment of the gas turbine of the present invention, and is a partial enlarged drawing of the region corresponding to part A in FIG. 3.

Figure 2:
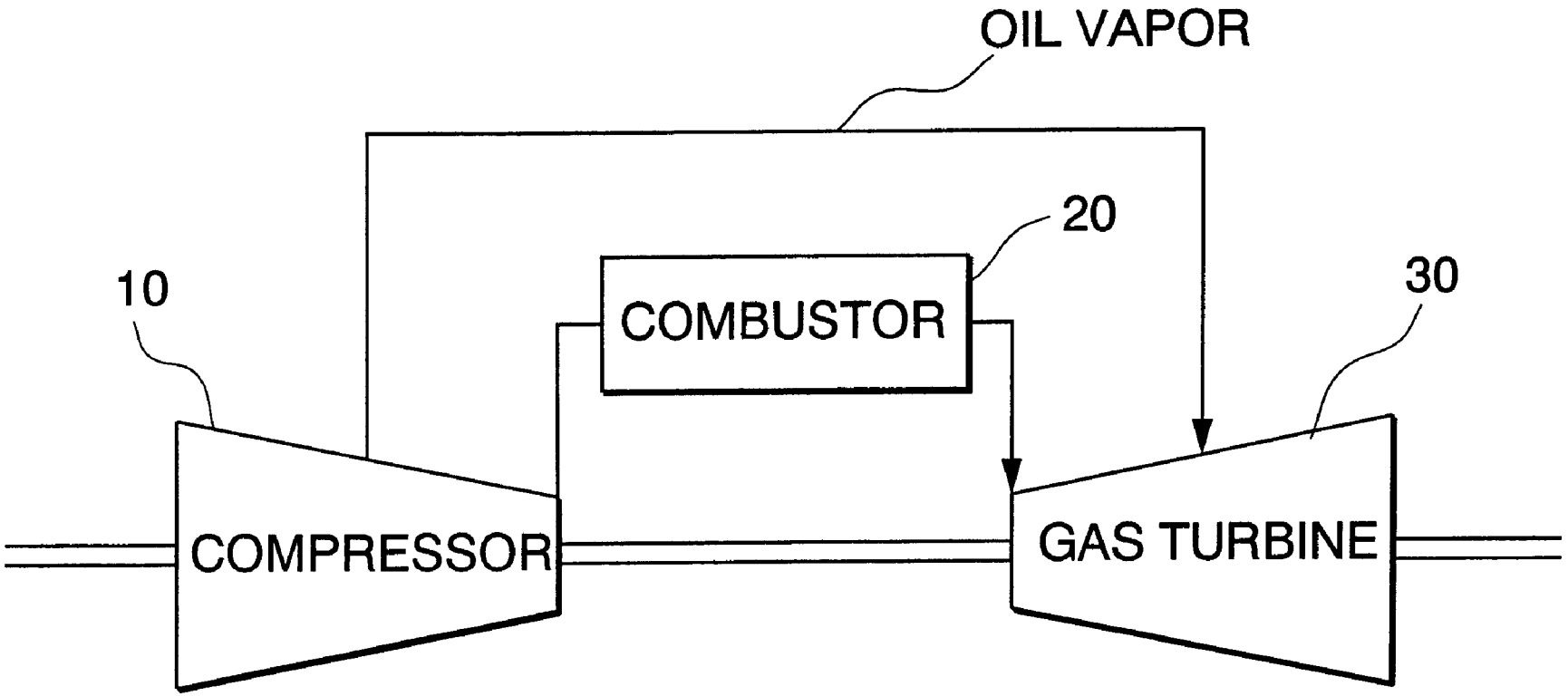
FIG. 2 is a diagram explaining schematic constitution of a gas turbine plant.

FIG. 2 is an explanatory drawing showing the schematic structure of the gas turbine plant.

FIG. 3 is a drawing showing the combustion gas flow path of a conventional gas turbine, and is a partial cross-sectional drawing viewed in a cross-section on the axis of the rotor.

Figure 4:
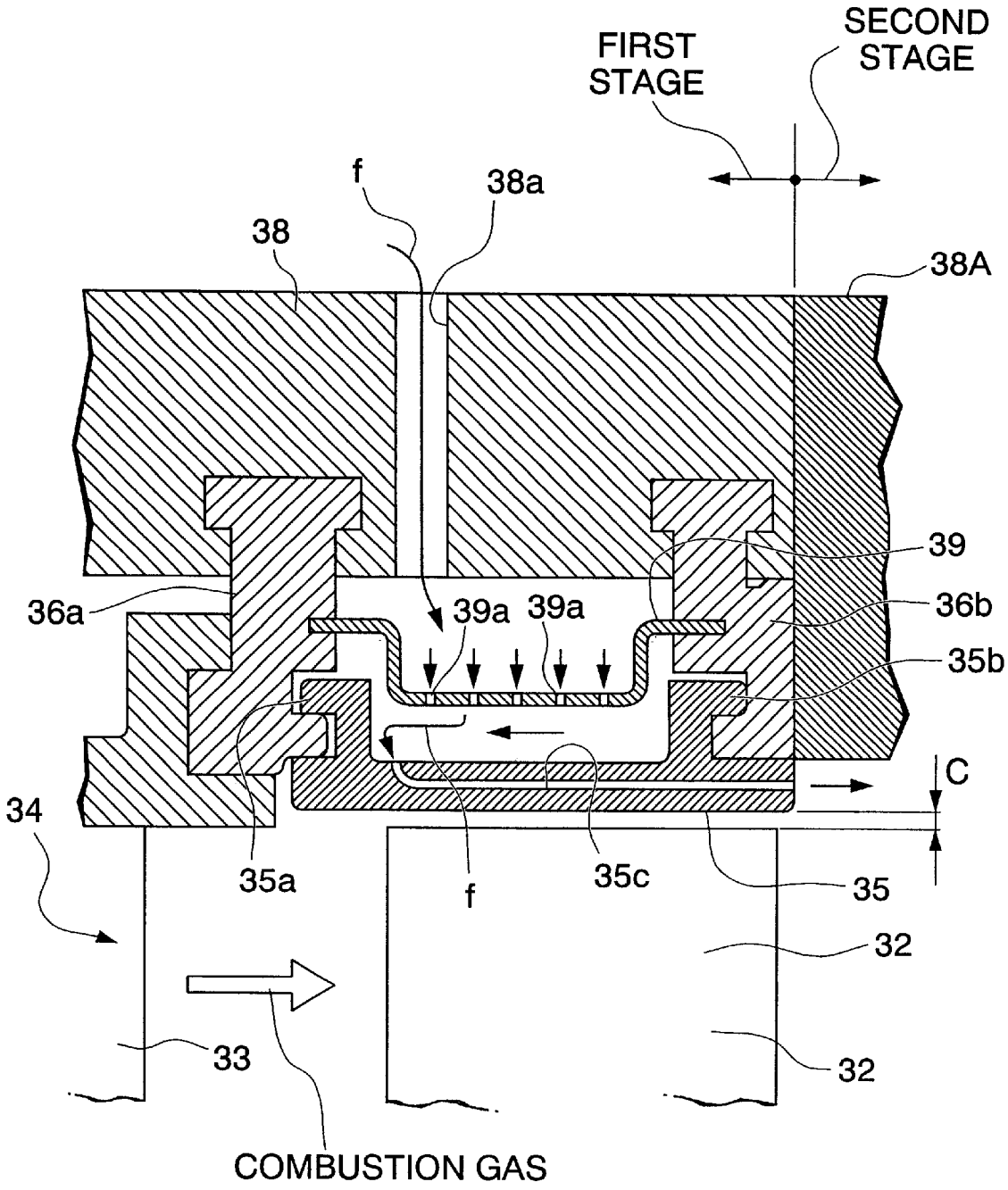
FIG. 4 is a diagram showing the conventional gas turbine and this figure is an enlargement corresponding to part A in FIG. 3.

FIG. 4 is a drawing showing a conventional gas turbine, and is an enlarged cross-sectional drawing of the part corresponding to part A in FIG. 3.

DETAILED DESCRIPTION OF THE INVENTION

Below, an embodiment of the gas turbine of the present invention will be explained with reference to FIG. 1. Of course, the present invention cannot be interpreted as being limited by the embodiment. Moreover, FIG. 1 is a drawing showing the essential components of the gas turbine of the present embodiment, and is a partial enlarged drawing corresponding to part A explained in the conventional technology.

The schematic structure of the gas turbine of the present invention comprises, in multiple stages in the axial direction of the rotor, unit stages comprising a plurality of rotor blades 32 that are disposed in a ring on the periphery of the rotor and rotate along with the rotor, a partition ring 35 that encloses the periphery of these rotor blades 32 and forms a combustion gas flow path 34 therein, and a blade ring (for example, the upstream blade ring 200 and the downstream blade ring 200A to be described below) that covers the periphery of the thermally insulting ring (for example, the upstream thermally insulating ring 101) that supports the partition ring 35 therein, and is particularly characterized by the support structure of the partition ring 35.

Below, mainly the characteristic features will be explained, but the other features that are identical to those in the structure explained in FIG. 3 have identical reference numerals, and their explanations are omitted.

As shown in FIG. 1, the gas turbine of the present embodiment has as one characteristic feature that, when viewing from the axial direction of the rotor, the upstream thermally insulating ring 101 is attached to the downstream blade ring 200A, which is positioned downstream side of the upstream blade ring 200 corresponding to the upstream thermally insulating ring 101.

In other words, in the direction of flow of the combustion gas that flows into the combustion gas flow path 34 (that is, the direction from the left side to the right side of the figure, and hereinafter, the left side of the figure is called as upstream and the right side is called as downstream), the first stage unit 100 is the unit stage positioned furthest upstream among the units, and the second stage unit 100A is the unit adjacent to the first stage unit 100 on the downstream side. Moreover, the upstream blade ring 200, which is the blade ring on the first stage unit 100 side, is positioned on the upstream side of the downstream blade ring 200A.

The upstream thermally insulating ring 101 has a two-part structure wherein a first member 102 that is positioned on the upstream side is combined with a second member 103 that is positioned on the downstream side with respect to the first member 102.

The first member 102 is a ring shaped member comprising an engagement groove 102*a* that engages the second member 103, an engagement grove 102*b* that engages the impinging plate 39, and an engagement groove 102*c* that engages the flange 35*a* of the partition ring 35. Furthermore, a flange 102*d* for bolt anchoring on the downstream blade ring 200A is formed on the first member 102, and the through holes 102*d*1 through which the bolts 104 pass are disposed in a circle centered on the axis of the rotor. Similarly, a plurality of screw holes 200A1 are formed corresponding to each of the through holes 102*d*1 on the downstream blade ring 200A.

The second member 103 is a round part that comprises an engagement groove 103*a* that engages with the impinging plate 39 and the engagement groove 103*b* that engages the flange 35*b* of the partition ring 35.

In addition, the first member 102 is fastened by a plurality of bolts 104 in a state wherein the first member 102 is assembled by being interposed between the downstream blade ring 200A, the second member 103, the partition member 35 (the other member), and the impingement plate 39 (the other member). When viewed in cross-section on the axis of the rotor, the upstream thermally insulating ring 101 fastened in this manner has a cantilever support structure supported only by the downstream blade ring 200A.

Moreover, in the present embodiment, the partition ring 35 and the impingement plate 39 have been respectively explained for the case that they are separate parts from the first member 102 and the second member 103, but this is not limiting, and a structure wherein the respective partition rings 35 and the impingement plates 30 are formed integrally with the first member 102 and second member 103 can be used. In this case, the number of parts can be reduced, and thus the manufacturing cost can be reduced. In addition, the number of assembly steps can be reduced.

Similarly, in the present embodiment, the case was explained in which the first member 102 and the second member 103 are separate members, but this is not limiting, and a structure in which the first member 102 and the second member 103 are integrally formed can be used. In this case, the number of parts can be reduced, and thus the manufacturing cost can be reduced.

The clearance flow path 106 through which the cooling bleed f is supplied to the first stage unit 100 (the unit positioned on the upstream side) is formed between the inner peripheral surface of the upstream blade ring 200 that covers the periphery of the upstream thermally insulating ring 101 and the outer peripheral surface of the upstream thermally insulating ring 101. The clearance flow path 106 is communicated with through holes 301, which are formed in the supporting member 300 adjacent to the upstream side of the upstream thermally insulating ring 101 and th bleed f is introduced through this through holes 301.

By forming the clearance flow path 106 in this manner, through holes for supplying the bleed f to the upstream blade ring 200 do not need to be formed. Therefore, deterioration in the structural strength of the upstream blade ring 200 can be prevented.

The gas turbine of the present embodiment provides a control apparatus 1000 that controls at least one of either the temperature or supply flow rate. This control apparatus comprises a cooling apparatus that adjusts the temperature of the bleed f and a flow rate control apparatus that adjusts the flow rate of the bleed f. Using this control apparatus, the clearance c formed between each of the rotor blades 32 and the partition ring 35 is actively controlled (active control) in the first stage unit 100. Specifically, by carrying out one or both of lowering the bleed temperature or increasing the bleed flow rate, the clearance c can be narrowed. Contrariwise, by carrying out one or both of increasing the bleed temperature or decreasing the bleed flow rate, the clearance c can be widened.

According to the gas turbine of the embodiment explained above, by installing an upstream thermally insulating ring 101 on the downstream blade ring 200A, the amount of thermal expansion of the upstream thermally insulating ring 101 (specifically, the amount of thermal expansion of the partition ring 35) can be made small during operation. Thereby, the clearance c between each of the rotor blades 32 and the partition ring 35 can be reduced to a minimum.

Moreover, in the gas turbine of the present embodiment, the present invention has a structure that is applied to the first unit 100 that is furthest upstream, but this is not limiting, and naturally this can be applied to the units that are downstream from the second stage unit 100A. However, by applying the present invention to the first stage unit 100, as is the case in this embodiment, the increase in power of the gas turbine can be particularly effectively attained.

According to a first aspect of the gas turbine of the present invention, by installing an upstream thermally insulating ring on the downstream blade ring, the amount of thermal expansion of the upstream thermally insulating ring can be made small during operation. Thereby, the clearance between each of the rotor the partition ring supported by the upstream thermally insulating ring can be reduced to a minimum.

In addition, according to a second aspect of the gas turbine, the effect of the first aspect can be reliably attained.

According to the third aspect of the gas turbine, a structure is used in which the upstream thermally insulating ring is partitioned into a first member and a second member, and the second member is installed interposed between the downstream blade ring and the first member. By using this type of partitioned structure, the upstream thermally insulating ring can be removed during maintenance, and mounting on the downstream blade ring becomes simplified, and the maintainability improves.

In addition, according to the fourth aspect of the gas turbine, by using a structure wherein the first member, the second member, and other members are interposed, a separate anchoring structure for anchoring the other members to the downstream blade ring becomes unnecessary, and since the number of parts can be reduced, the maintainability is improved.

In addition, according to a fifth aspect of the gas turbine, by integrally forming the other members with the first member and second member, the number of parts can be reduced, the manufacturing cost reduced, and the maintainability improved.

In addition, according to a sixth aspect of the gas turbine, by integrally forming the first member and second member, the number of parts can be decreased, and thus the manufacturing cost can be reduced.

In addition, according to the seventh aspect of the gas turbine, through holes for bleed supply do not need to be formed in the upstream blade ring side, and thus a decrease in the structural strength of the upstream blade ring can be avoided.

In addition, according to an eighth aspect of the gas turbine, by providing a control unit that controls either one or both of the temperature or supply flow rate of the bleed, the clearance formed between each of the rotor blades and the partition ring supported by the upstream thermally insulating ring can be actively controlled (active control) in the unit stage positioned on the upstream side.

In addition, according to a ninth aspect of the gas turbine, by applying the present invention to the first stage unit, the increase in power of the gas turbine can be particularly effectively obtained.

What is claimed is:

1. A gas turbine comprising:

a plurality of rotor blades, which are disposed on the periphery of the rotor and rotate with the rotor;

a plurality of partition rings which enclose the periphery of these rotor blades and forms a combustion gas flow path therein; and a plurality of blade rings which are disposed around the periphery of said partition rings and support said partition rings through a thermally insulating ring;

wherein, when viewed from the axial direction of said rotor, the upstream thermally insulating ring, that supports the partition ring located relatively upstream among said plurality of partition rings, is installed on the downstream blade ring, which is positioned downstream of said blade ring, which corresponds to said upstream thermally insulating ring.

2. A gas turbine according to claim 1 having a cantilever support structure in which said upstream thermally insulating ring is supported by said downstream blade ring when viewed in a cross-section along the axis of said rotor.

3. A gas turbine according to claim 1 and claim 2 wherein said upstream thermally insulating ring has a first member positioned relatively on the upstream side in the direction of the flow of said combustion gas and a second member positioned on the downstream side with respect to said first member, and with respect to said downstream blade ring, said first member is installed in a state wherein said second member is interposed between said first member and said downstream blade ring.

4. A gas turbine according to claim 3 wherein the other member is interposed between said first member and said second member.

5. A gas turbine according to claim 4 wherein said other member is integrally formed with either one of the first member or the second member.

6. A gas turbine according to claim 3 and claim 4 wherein said fist member and said second member are integrally formed.

7. A gas turbine according to any of claims 1 to 6 wherein a clearance flow path, for flowing the cooling bleed towards said partition ring supported by said upstream thermally insulating ring, is formed between the upstream blade ring that covers the periphery of said upstream thermally insulating ring and said upstream thermally insulating ring.

8. A gas turbine according to any of claims 1 to 7 wherein the gas turbine further comprises a control unit that controls one or both of the temperature or the flow rate of the cooling bleed for cooling said partition ring, which is supported by said upstream thermally insulating ring.

9. A gas turbine according to any of claims 1 to 8 wherein said partition ring supported by said upstream thermally insulating ring is provided in the first stage unit that is located furthest upstream in said axial direction of said rotor, and said downstream blade ring is provided in the second stage unit which is located adjacent to said first stage unit.

* * * * *